US009415591B2

(12) United States Patent
Lee et al.

(10) Patent No.: US 9,415,591 B2
(45) Date of Patent: Aug. 16, 2016

(54) APPARATUSES AND METHODS FOR ELECTROHYDRODYNAMIC PRINTING

(71) Applicant: Board of Regents, The University of Texas System, Austin, TX (US)

(72) Inventors: Woo Ho Lee, Flower Mound, TX (US); Caleb Nothnagle, Arlington, TX (US); Jeongsik Shin, Keller, TX (US); Muthu Bandage Jayathilaka Wijesundara, Fort Worth, TX (US)

(73) Assignee: THE BOARD OF REGENTS OF THE UNIVERSITY OF TEXAS SYSTEM, Austin, TX (US)

( * ) Notice: Subject to any disclaimer, the term of this patent is extended or adjusted under 35 U.S.C. 154(b) by 0 days.

(21) Appl. No.: 14/638,708

(22) Filed: Mar. 4, 2015

(65) Prior Publication Data

US 2015/0266297 A1 Sep. 24, 2015

Related U.S. Application Data

(60) Provisional application No. 61/948,851, filed on Mar. 6, 2014.

(51) Int. Cl.

| | |
|---|---|
| ***B41J 2/14*** | (2006.01) |
| ***B41J 2/06*** | (2006.01) |
| ***B41J 2/02*** | (2006.01) |

(52) U.S. Cl.

CPC ..... *B41J 2/06* (2013.01); *B41J 2002/14491* (2013.01); *B41J 2202/04* (2013.01)

(58) Field of Classification Search

CPC ..... B41J 2002/033; B41J 2/03; B41J 2/02; B41J 2002/022; B41J 2/125; B41J 2/14314; B41J 2002/14491; B41J 2/06; B41J 2202/04

USPC ..... 347/14, 47, 73–76, 16, 50, 55

See application file for complete search history.

(56) References Cited

U.S. PATENT DOCUMENTS

| | | | | |
|---|---|---|---|---|
| 8,579,411 | B2 | 11/2013 | Kim et al. | 347/47 |
| 9,061,494 | B2 | 6/2015 | Rogers et al. | 347/55 |
| 2005/0212870 | A1* | 9/2005 | Chiao | A61M 35/00 347/76 |
| 2015/0015629 | A1* | 1/2015 | Motala et al. | 347/10 |

OTHER PUBLICATIONS

Barros et al., "Synthesis and X-ray Diffraction Characterization of Nanocrystalline ZnO Obtained by Pechini Method," *Inorganic Matter.*, 2006, 42(12):1348-1351.

(Continued)

*Primary Examiner* — Jannelle M Lebron

(74) *Attorney, Agent, or Firm* — Norton Rose Fulbright US LLP

(57) ABSTRACT

This disclosure includes electrohydrodynamic (EHD) printer nozzles, associated printer heads and printers, and methods for using the same. Some EHD nozzles include a circuit with at least one depressible electrical connector and a housing configured to receive a dispensing device such that electrical communication is permitted between the at least one depressible electrical connector and a conductive tip of the dispensing device, where the housing is further configured to be releasably coupled to a printer head such that voltage can be applied across the conductive tip. Some nozzles include an additional electrode. Some of the present methods include inserting a dispensing device into an EHD nozzle having a housing with a depressible electrical connector such that the connector contacts a conductive tip of the dispensing device and applying a voltage across the conductive tip. Others of the present methods include performing maskless lithography with the present EHD printers and components.

23 Claims, 10 Drawing Sheets

(56) References Cited

OTHER PUBLICATIONS

Chen. et al., "A new method for significantly reducing drop radius without reducing nozzle radius in drop-on-demand drop production," *Phy. Fluids.*, 2002; 14: L1-L4.

Choi et al., "Scaling laws for jet pulsations associated with high-resolution electrohydrodynamic printing," *Appl. Phy. Lett.*, 2008; 92: 123109 (1-3).

Park et al., "High-resolution electrohydrodynamic jet printing," *Nat. Mater.*, 2007; 6: 782-789.

* cited by examiner z

APPARATUSES AND METHODS FOR ELECTROHYDRODYNAMIC PRINTING

CROSS-REFERENCE TO RELATED APPLICATIONS

This application claims priority to U.S. Provisional Patent Application No. 61/948,851 filed Mar. 6, 2014, which is incorporated by reference in its entirety.

STATEMENT REGARDING FEDERALLY SPONSORED RESEARCH OR DEVELOPMENT

This invention was made with government support under N00014-08-C-0390 and N00014-11-C-0391 awarded by the Office of Naval Research. The Government has certain rights in the invention.

BACKGROUND

1. Field of Invention

The present invention relates generally to electrohydrodynamic printing and more specifically, but not by way of limitation, to nozzles for electrohydrodynamic printers.

2. Description of Related Art

Examples of electrohydrodynamic printer nozzles are disclosed in U.S. patent application Ser. No. 12/713,886 and U.S. patent application Ser. No. 12/669,287.

Electrohydrodynamic (EHD) printing is a highly versatile printing technology that can provide printing resolutions in the micron to submicron range. EHD printing generally uses a strong electric field to eject printing media onto a substrate. Typically, a large bias voltage is applied to a nozzle that is in fluid communication with a printing media reservoir. The electric field generated by the bias voltage draws the printing media through the nozzle and ejects it towards a substrate. Such printers are capable of printing high resolution features that are orders of magnitude smaller than printer nozzle size (e.g., inner diameter) [1]. Thus, EHD printers can be used during creation of a variety of devices, including, but not limited to, electronics (e.g., printed circuit boards), sensors (e.g., transmission fluid temperature sensors, and gas sensors), power modules, interconnects, biomedical devices (e.g., templates for cell growth), displays, actuators, energy harvesters, transistors, and organic light-emitting diodes (LEDs), just to name a few. The range of potential applications illustrate the usefulness of EHD printers in direct printing (e.g., sensors), front-end and back-end fabrication (e.g., transistors and PCBs, respectively), and packaging (e.g., interconnects).

EHD printing technology can also reduce cost and waste present in traditional microfabrication. For example, mask-based lithography, in general, is a microfabrication process used to create micro- or nano-scale patterns on a substrate and is commonly used to create integrated circuits. Typically, a light-sensitive chemical, also known as a photoresist, is deposited onto a substrate. An optical mask comprising a pattern can then be used to mask desired portions of the substrate. For example, in simpler proximity or contact systems, the optical mask is placed in close proximity to or in direct contact with the substrate. A specialized light source can then be used to expose the unmasked portions of the substrate, thus transferring the desired pattern to the substrate (e.g., by exposing unmasked portions of the light-sensitive photoresist). Traditional mask-based lithography can involve highly specialized equipment. For example, optical masks typically are constructed out of a fused quartz substrate layered with chromium, where the chromium layer is etched with a laser to create the desired masking pattern. Additionally, photoresists can comprise relatively expensive chemicals that are usually wasted (e.g., removed from the substrate and discarded) during the masked based lithography process. Current alternative methods for achieving similar results are electron beam lithography, which is time consuming and expensive, nano-imprint technology, which generally involves expensive molds made of specialized materials, and piezo-driven printing, which is typically limited to low viscosity printing materials (e.g., with a viscosity less than 50 centipoise (cP)) and thus can require multiple superimposed printing runs when printing thicker structures and offers a relatively low printed feature resolution.

SUMMARY

The present EHD printers, components, and methods are capable of directly printing micro- or nano-scale patterns onto a substrate without the need for the specialized equipment or substantial amounts of chemicals (which may be harmful to the environment). Additionally, the present EHD printers, components, and methods are not limited to light-sensitive printing materials, and thus printed patterns may not require additional developing steps before use. Therefore, the present EHD printers, components, and methods can accomplish direct pattern printing in both an economical and time-efficient fashion. For optimal direct pattern transfer, the printing media can be optimized for viscosity, surface tension, electrical conductivity, solvent content, and/or evaporation rate. For example, for maskless lithography, it may be desirable that printing media be highly viscous to create thick structures, contain little solvent, adhere to the substrate, and/or resist any subsequent post-processing steps that may be used after direct pattern transfer. Embodiments of the present printing media are so modified and, in some embodiments, comprise a modified commercially available photoresist.

Damage can frequently occur to an EHD printer nozzle. Printer nozzle tips are typically small and potentially fragile. Additionally, due to the high bias voltages involved, arcing can occur and burn the nozzle, which may necessitate nozzle replacement or repair. Embodiments of the present EHD nozzles, however, can be constructed from relatively inexpensive components, without the need for specialized fabrication equipment, and can include robust, reliable, and reusable electrical connections to the printer nozzle and/or the printer head that make nozzle assembly and disassembly relatively quick, thus facilitating replacement of the EHD nozzle assembly or EHD nozzle tip in the event of damage (e.g., due to arcing).

Embodiments of the present apparatus and methods can be configured to provide an easily repairable and/or replaceable EHD nozzle and/or nozzle tip through depressible electrical connectors configured to allow for both releasable coupling and electrical communication between the EHD nozzle, EHD nozzle tip, EHD printer head and/or EHD printer.

Some embodiments of the present EHD printer nozzles comprise: a circuit having at least one depressible electrical connector; and a housing having a first end, a second end, and a channel extending from the first end to the second end, the housing configured to be releasably coupled to a printer head, and the channel configured to removably receive a dispensing device with a conductive tip such that electrical communication is permitted between the conductive tip and the at least one depressible electrical connector; where the circuit is configured to apply a voltage across the conductive tip; and where the EHD printer nozzle is configured to be removably coupled to an EHD printer head. In some embodiments, the circuit comprises two depressible electrical connectors, the depressible electrical connectors configured to contact substantially opposite sides of the conductive tip. In some embodiments, at least one depressible electrical connector comprises a spring-loaded electrical connector. In some embodiments, the spring-loaded electrical connector comprises a pogo-pin. In some embodiments, the circuit comprises at least one header pin configured to be in electrical communication with the printer head when the first end is coupled to the printer head. In some embodiments, the circuit comprises at least one contact printed circuit board (PCB). In some embodiments, the nozzle further comprises an electrode disposed proximate the second end of the housing. In some embodiments, the circuit is configured to apply a voltage across the electrode. In some embodiments, the circuit further comprises first and second parallel portions, the first parallel portion configured to be in electrical communication with the conductive tip and the second parallel portion configured to be in electrical communication with the electrode. Some embodiments further comprise a second circuit configured to apply a voltage across the electrode. In some embodiments, the circuit is configured to apply a first voltage across the conductive tip and the second circuit is configured to apply a second voltage across the electrode, where the second voltage is different than the first voltage. In some embodiments, the electrode comprises an opening having a transverse dimension. In some embodiments, the opening is substantially centered on a longitudinal axis of the conductive tip.

Some embodiments of the present EHD printer heads comprise: an embodiment of the present nozzles; and a reservoir in fluid communication with the nozzle, the reservoir configured to contain printing media; where the reservoir is configured to be coupled to a fluid source such that the fluid source can deliver fluid to or remove fluid from the reservoir to adjust an internal pressure of the reservoir. Some embodiments comprise a power source configured to electrically communicate with the circuit to apply a voltage across the conductive tip. In some embodiments, the power source is configured to electrically communicate with the circuit to apply a voltage across the electrode. In some embodiments, the power source is configured to electrically communicate with the second circuit to apply a voltage across the electrode. Some embodiments further comprise a second power source configured to electrically communicate with the second circuit to apply a voltage across the electrode.

Some embodiments of the present EHD printers comprise: an embodiment of the present printer heads and a power source configured to supply a voltage to the conductive tip. In some embodiments, the power source is further configured to supply a voltage to the electrode. Some embodiments further comprise a second power source configured to supply a voltage to the electrode. Some embodiments comprise a fluid source configured to deliver fluid to or remove fluid from the reservoir to adjust an internal pressure of the reservoir. Some embodiments further comprise a working surface. Some embodiments further comprise at least one orientation actuator configured to adjust an orientation of the working surface relative to the printer head. Some embodiments further comprise at least one sensor configured to capture data indicative of the orientation of the working surface relative to the printer head. Some embodiments further comprise a processor configured to adjust the orientation of the working surface relative to the printer head based on the data captured by the at least one sensor.

Some embodiments of the present methods comprise: inserting a dispensing device with a conductive tip into an EHD nozzle, the nozzle having a housing with at least one depressible electrical connector, where the dispensing device is inserted such that the depressible electrical connector contacts the conductive tip; and applying a voltage across the conductive tip by enabling electrical communication between the depressible electrical connector and a power source. In some embodiments, the nozzle further has an electrode and the present methods further comprise applying a voltage across the electrode by enabling electrical communication between the electrode and a second power source. In some embodiments, the power source and the second power source comprise the same power source.

Some of the present direct printing methods for maskless lithography comprise: generating an electric field around an EHD printer nozzle, the nozzle having a housing with at least one depressible electrical connector and a dispensing device with a conductive tip disposed in the housing such that electrical communication is permitted between the conductive tip and the depressible electrical connector, where the electric field is generated by enabling electrical communication between the depressible electrical connector and a power source to apply a voltage across the conductive tip; and ejecting viscous fluid from the nozzle onto a substrate. In some embodiments, the nozzle further has an electrode and the generating an electric field further comprises enabling electrical communication between the electrode and a power source. In some embodiments, the power source and the second power source comprise the same power source. Some embodiments further comprise adjusting a distance between the electrode and the conductive tip. Some embodiments further comprise maintaining a constant hydrostatic pressure at an exit of the nozzle by adjusting an internal pressure of a fluid reservoir that is in fluid communication with the nozzle. Some embodiments further comprise adjusting the electric field. Some embodiments further comprise adjusting a distance between the nozzle and the substrate. Some embodiments further comprise moving the nozzle relative to the substrate.

Some embodiments of the present methods further comprise curing the viscous fluid. In some embodiments, the curing comprises ultraviolet (UV) curing. In some embodiments, the UV curing comprises exposing the viscous fluid to ultraviolet light having a power of approximately 500 watt (W) for a time of approximately 1 minute. In some embodiments, the curing comprises baking. In some embodiments, the baking comprises heating the viscous fluid at a temperature within the range of approximately 100 degrees Celsius (° C.) to approximately 110° C. for a time of approximately 1 minute. In some embodiments, the curing comprises sintering. In some embodiments, the sintering comprises heating the viscous fluid at a temperature greater than or equal to approximately 400° C. for a time of approximately 45 minutes.

In some embodiments of the present methods, the substrate comprises a silicon wafer. In some embodiments, the substrate comprises glass. In some embodiments, the substrate comprises polymer. In some embodiments, the substrate comprises ceramic.

In some embodiments of the present methods, the viscous fluid comprises a negative epoxy resist modified with at least one of a surfactant and a solvent such that the viscous fluid has a viscosity and a surface tension suitable for maskless lithography. In some embodiments, the viscous fluid comprises an ionic metal salt. In some embodiments, the ionic metal salt comprises at least one of zinc nitrate, zinc acetate, and tin nitrate. In some embodiments, the viscous fluid comprises poly(2,3-dihydrothieno-1,4-dioxin)-poly(styrenesulfonate).

In some embodiments, the viscous fluid comprises from 1-10% poly(2,3-dihydrothieno-1,4-dioxin)-poly(styrenesulfonate). In some embodiments, the viscous fluid comprises a matrix material. In some embodiments, the viscous fluid comprises from 1-20% of the matrix material. In some embodiments, the matrix material comprises at least one of polyethylene glycol, polyvinylpyrrolidone, and polyvinyl alcohol. In some embodiments, the viscous fluid comprises a solvent. In some embodiments, the viscous fluid comprises from 10-90% of the solvent. In some embodiments, the solvent comprises at least one of ethylene glycol, N-Methyl-2-pyrrolidone (NMP), N-methylpyrrolidone, dimethyl sulfoxide, ethanol, and methanol. In some embodiments, the viscous fluid comprises a surfactant. In some embodiments, the surfactant comprises anionic fluorinated polyether di(ammonium sulfate) salt.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments are described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

DETAILED DESCRIPTION OF ILLUSTRATIVE EMBODIMENTS

Figure 1B:
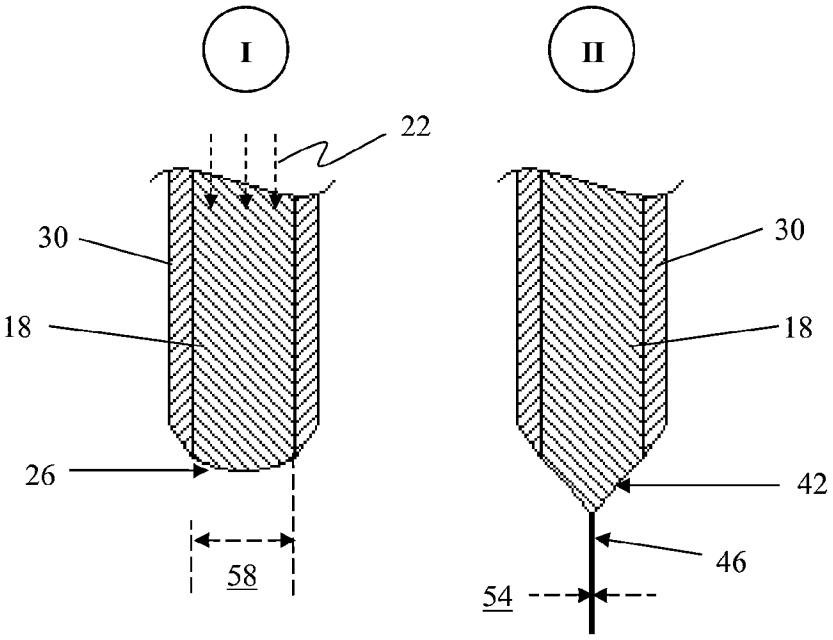
FIG. 1B depicts a cutaway cross-sectional side view of the nozzle of the printer of FIG. 1A during two operating modes.
Figure 1A:
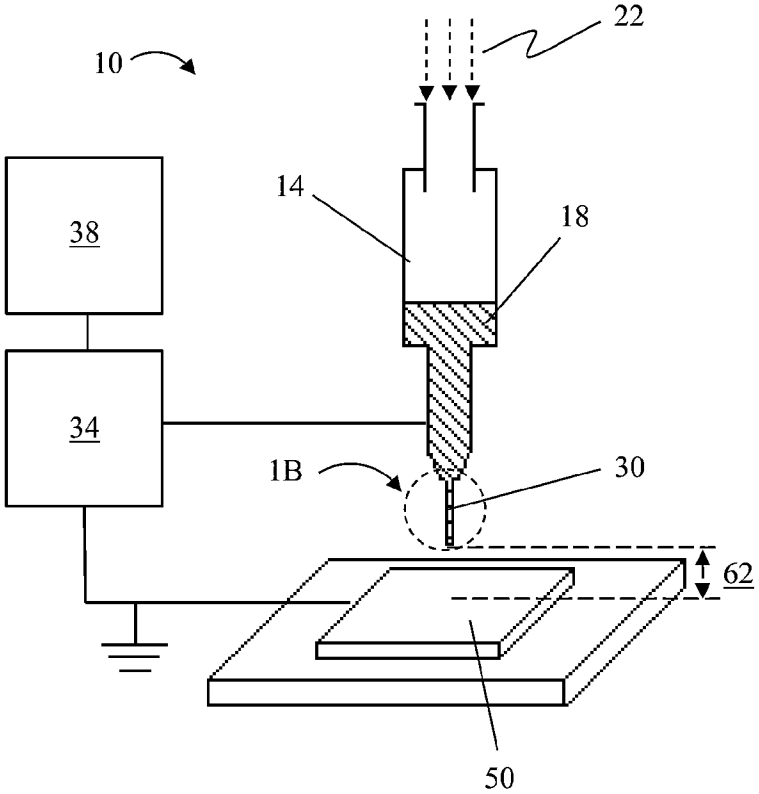
FIG. 1A depicts certain components of one example of an EHD printer.

Referring now to the drawings, and more particularly to FIGS. 1A-1B, FIG. 1A depicts certain components of an illustrative example of an EHD printer 10, which is generally representative of some of the present apparatuses and methods; and FIG. 1B depicts cutaway cross-sectional side views of a nozzle of printer 10 in two operating modes. Typically, EHD printers work by using a strong electric field to cause the ejection of printing media onto a substrate. For example, as shown, printer 10 comprises a reservoir 14 which can contain printing media 18. EHD printing is desirable, in part, due to its ability to print micro- and nano-scale features with various materials [2], and printing media 18 can therefore comprise a variety of mediums, for example, mediums with viscosities within the range of about 1 cP to about 1000 cP and electrical conductivities within the range of about $10^{-13}$ millisiemens per cm (mS/cm) to $10^{-3}$ mS/cm, including, for example, metals, semiconductors, polymers, and living cells. The capability to print at such high viscosities, for example, can allow printing of thicker microstructures. Pressure (e.g., indicated by arrows 22) can be internally applied to reservoir 14 to create a meniscus 26 at the exit of nozzle 30 (e.g., in printer 10, comprising a gold coated glass capillary with a 10 micrometer (μm) inner diameter), which is in fluid communication with reservoir 14 (e.g., as shown in operating mode I of FIG. 1B). A large bias voltage, which can be supplied by power supply 34 (which can include and/or be controlled by a function generator 38), can be applied to nozzle 30. Through application of bias voltage, meniscus 26 can form into cone 42 and printing media 18 can be ejected as jet 46 (e.g., a continuous jet during printing operation) onto substrate 50. For example, as bias voltage is applied to nozzle 30, a voltage difference between substrate 50 and nozzle 30 can be realized. Mobile ions in printing media 18 can accumulate at the surface of meniscus 26 where mutual Coulombic repulsion and electrostatic attraction to substrate 50 can create tangential stress on meniscus 26, resulting in the formation of cone 42 (also known as a Taylor cone) (e.g., as shown in operating mode II). When the bias voltage is sufficiently high, the tangential stress can overcome the surface tension of printing media 18 at the surface of cone 42, and printing media can be ejected towards substrate 50. By controlling printing media characteristics (e.g., viscosity, surface tension, conductivity and/or the like), stand-off distance 62 (e.g., the distance between nozzle 30 and substrate 50), pressure 22 (e.g., back pressure), bias voltage, nozzle characteristics (e.g., inner diameter 58, shape, and/or the like) and/or the like, ejection characteristics can be adjusted. For example, as shown in operating mode II, printing media 18 is ejected as stable jet 54. However, ejection characteristics (e.g., flow rate, jet diameter, stability, and/or the like) can vary, to include, without limitation, droplets, whipping (e.g., unstable) jets, and/or the like. As shown, during EHD printing, diameter 54 of jet 46 can be significantly smaller (e.g., up to two orders of magnitude) than nozzle 30 exit diameter 58.

Figure 2B:
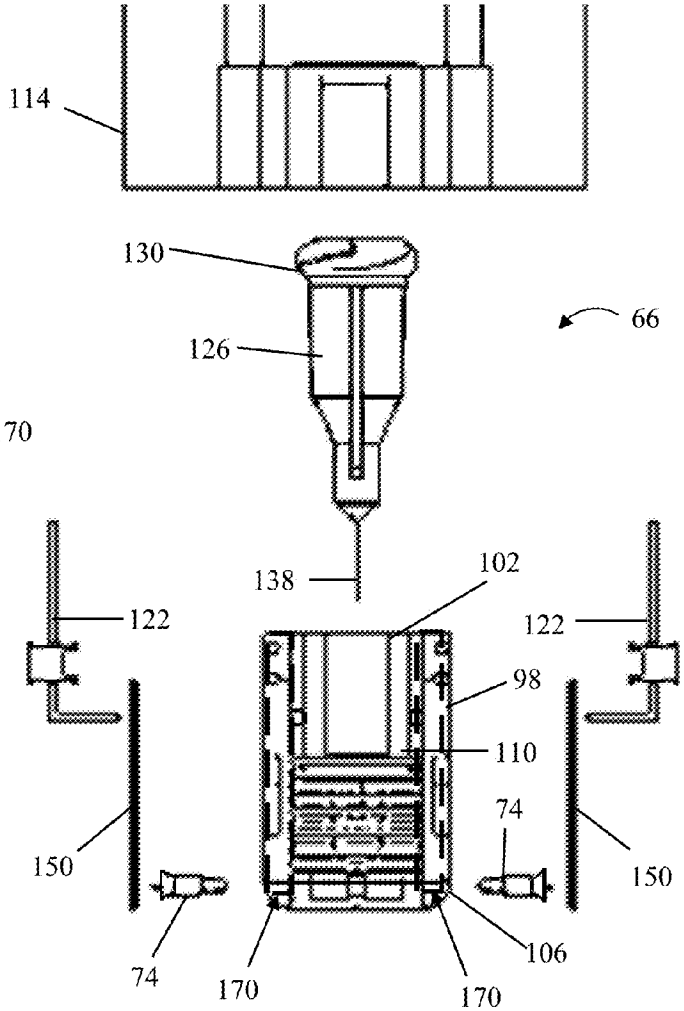
FIG. 2B depicts an exploded side view of the first embodiment of the present nozzles.
Figure 2A:
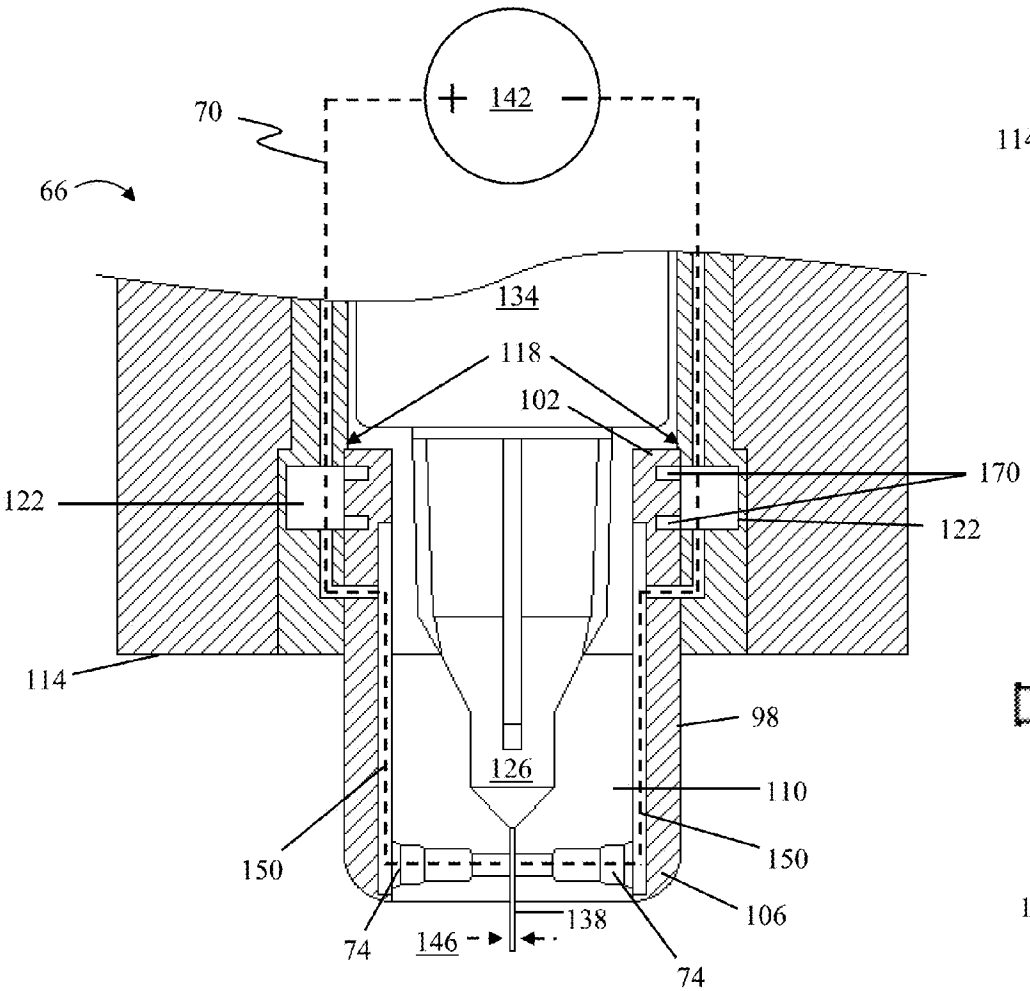
FIG. 2A depicts a cutaway partially cross-sectional side view of a first embodiment of the present nozzles.
Figure 3:
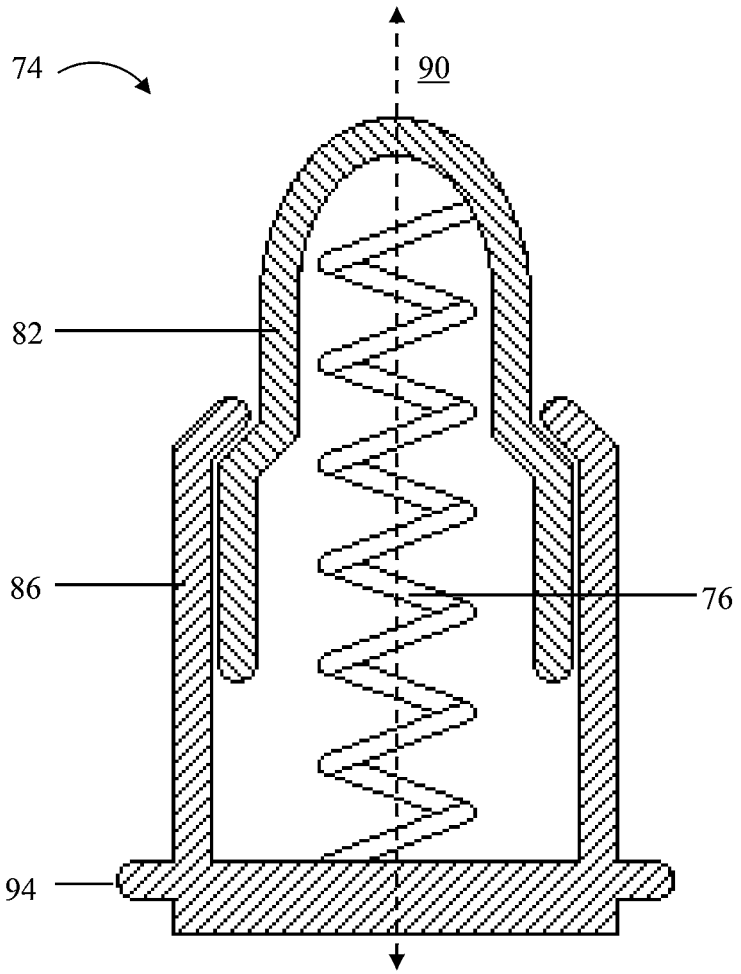
FIG. 3 depicts a partially cross-sectional side view of a depressible electrical connector that is suitable for use in the first embodiment of the present nozzles.

FIGS. 2A and 2B depict different views of a first embodiment 66 of the present nozzles. In the embodiment shown, nozzle 66 comprises a circuit 70 (e.g., indicated by dashed lines) which has at least one depressible electrical connector 74 (e.g., two depressible electrical connectors 74, as in the depicted embodiment). As used in this disclosure, the term depressible means deformable and/or compressible, regardless of an ability to completely return to a pre-depressed state. Referring additionally to FIG. 3, in the embodiment shown, depressible electrical connector 74 is a spring-loaded electrical connector (e.g., a pogo-pin connector). In this embodiments, connector 74 comprises a spring 76 that allows the connector to depress (e.g., a first portion 82 of connector 74 can move inwardly relative to a second portion 86 substantially along longitudinal axis 90 of the connector and through compression of spring 76) while permitting continuous electrical communication through the connector (e.g., through spring 76 and/or contact between first portion 82 and second portion 86). In the embodiment shown, connector 74 additionally comprises coupling features (e.g., ridge 94) to facilitate secure coupling of connector 74 with other components (as described in more detail below). In other embodiments, depressible electrical connectors 74 can comprise any connectors that permit the functionality described in this disclosure (e.g., elastomeric connectors, fuzz button connectors, spring probe connectors, and/or the like).

In the embodiment shown, depressible electrical connectors 74 may additionally provide and/or improve structural stability by applying a restraining force (e.g., via spring and/or spring-like compression of the connectors) to conductive tip 138 when dispensing device 126 is received by nozzle housing 98 and the connectors are in electrical communication (and contact) with the conductive tip (as described in more detail below). In this embodiment, nozzle 66 comprises a housing 98 having a first end 102, a second end 106, and a channel 110 extending from the first end to the second end (e.g., the housing may be fabricated using a stereolithography (SLA) three-dimensional (3D) printer). In the embodiment shown, housing 98 (e.g., first end 102) is configured to be releasably coupled to a printer head 114. Such releasable coupling can be accomplished through a friction fit between nozzle housing 98 and printer head 114 and/or with interlocking features 118 configured to securely and precisely locate the nozzle housing relative to the printer head (e.g., nozzle housing 98 is physically restrained from moving past and rests against interlocking features 118 when fully inserted into printer head 114). In other embodiments, such releasable coupling may be accomplished through different and/or additional features such as fasteners (e.g., screws, pins, and/or the like) removably inserted into and/or through printer head 114 and into and/or through nozzle housing 98, other interlocking features (e.g., tabs), a threaded connection between printer head 114 and nozzle housing 98, latches, and/or the like. Additionally and/or alternatively, such releasable coupling can be achieved and/or facilitated through coupling of header pins 122 of circuit 70 to printer head 114 (described in more detail below).

In the embodiment shown, circuit 70 comprises at least one header pin 122 (e.g., two header pins, as shown) configured to be in electrical communication with printer head 114 when first end 102 of nozzle housing 98 is releasably coupled to printer head 114. For example, in the embodiment shown, header pins 122 are constructed from a conductive material and protrude past first end 102 of nozzle housing 98 where such protruding sections can be received with conductive receptacles (e.g., sockets) on and/or within printer head 114 (e.g., such that printer head 114 and circuit 70 are in electrical communication). In the embodiment shown, channel 110 is configured to removably receive a dispensing device 126. For example, channel 110 can comprise interlocking features that substantially correspond to an outside surface of dispensing device 126 such that dispensing device 126 can be received by channel 110 through first end 102 and be engaged (e.g., removably received) by such interlocking features. In other embodiments, channel 110 can be substantially hollow and can receive dispensing device 126 through first end 102 and/or second end 106. In such embodiments, securing of dispensing device 126 relative to nozzle housing 98 can be accomplished through releasable attachment between dispensing device 126 and printer head 114 and/or fluid reservoir 134 (e.g., through surfaces configured for a friction fit, fasteners, interlocking features, a threaded connection, latches, and/or the like).

In the embodiment shown, dispensing device 126 comprises a threaded portion 130 for releasable coupling with printer head 114 and/or reservoir 134 (shown in FIG. 2B). In this embodiment, the reservoir may be inserted into and/or through printer head 114 and twisted to engage threaded portion 130 of the dispensing device, thus securing and/or sealing reservoir 134 and/or dispensing device 126 relative to printer head 114. However, in other embodiments, dispensing device 126 can comprise any releasable coupling structure which permits the functionality described in this disclosure, including, but not limited to, surfaces configured for a friction fit, fasteners, interlocking features, latches, and/or the like disposed on dispensing device 126, printer head 114, and/or reservoir 134. Additionally, sealing between dispensing device 126 and printer head 114 and/or reservoir 134 can be accomplished through any structure which permits the functionality described in this disclosure, including, but not limited to, O-rings, sealant, sealing tape, compression fittings, and/or the like.

Figure 4:
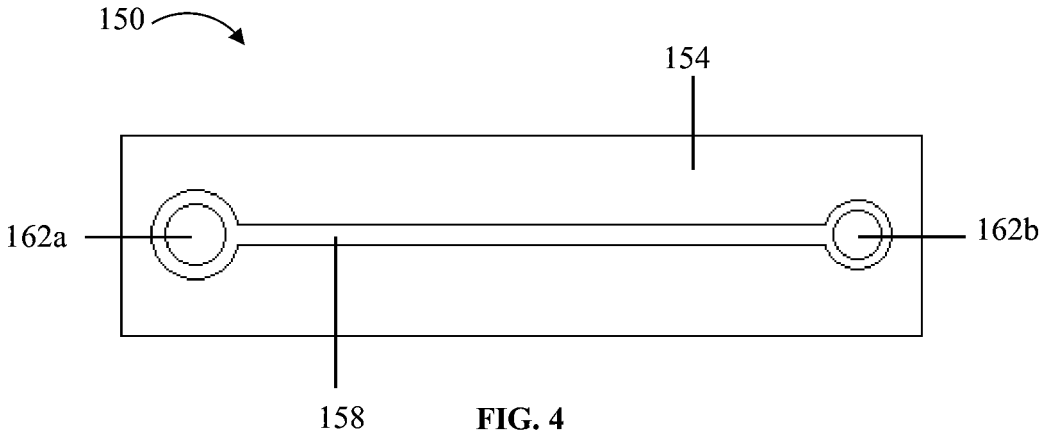
FIG. 4 depicts a top view of a PCB suitable for use in at least the first embodiment of the present nozzles.

In the embodiment shown, dispensing device 126 comprises a conductive tip 138 such that electrical communication is permitted between circuit 70 and the conductive tip. For example, in the embodiment shown, when dispensing device 126 is received by nozzle housing 98, conductive tip 138 can be in electrical communication with depressible electrical connectors 74 (e.g., in contact) such that electricity can flow through circuit 70 and into conductive tip 138. To illustrate, circuit 70 can apply a bias voltage across conductive tip 138, for example, supplied by power source 142). In the embodiment shown, nozzle 66 comprises two depressible electrical connectors 74, where the connectors are configured to contact substantially opposite sides of the conductive tip (e.g., to facilitate circuit 70 in applying a bias voltage across the conductive tip). However, in other embodiments, the present nozzles may comprise any number of depressible electrical connectors which permits the functionality described in this disclosure (e.g., 1, 2, 3, 4, or more depressible electrical connectors). In the embodiment shown, conductive tip 138 comprises stainless steel, however, in other embodiments, conductive tip 138 can comprise any material which permits the functionality described in this disclosure, including, but not limited to, silver, gold, copper, aluminum, graphite, conductive polymers, and/or the like. In this embodiment, conductive tip 138 has an outer diameter 146 of 0.24 millimeters (mm) and an inner diameter of 0.1 mm (e.g., conductive tip is 38 gauge (ga)). In the embodiment shown, circuit 70 comprises at least one PCB 150 (e.g., two PCBs). Referring additionally to FIG. 4, PCB 150 comprises an electrically insulative substrate 154. In this embodiment, PCB 150 additionally comprises at least two holes 162*a* and 162*b*, and a conductive trace 158 between the holes (e.g., to permit electrical communication between hole 162*a* and hole 162*b*). PCBs 150 can be used to facilitate assembly and/or disassembly of nozzle housing 66 (e.g., for initial assembly or for repair in the event of damage, for example, due to arcing), as described in more detail below with reference to FIG. 2B.

FIG. 2B depicts an exploded side view of nozzle 66. To assemble nozzle 66, dispensing device 126 can be inserted through first end 102 of nozzle housing 98 where it can be engaged (e.g., with interlocking features, as described above) within channel 110. Depressible connectors 74 can then be inserted into receptacles 106 of nozzle housing 98 where the depressible connectors can depress and contact nozzle tip 138 (e.g., as described above). PCBs 150 can be inserted into slots 170 along and/or within the sides of nozzle housing 98. In the embodiment shown, holes 162*a* and 162*b* of PCB 150 have different sizes (e.g., hole 162*a* has a larger diameter than hole 162*b*) configured to facilitate correct assembly of nozzle 66. For example, smaller hole 162*b* can be configured to receive depressible electrical connector 74 (e.g., sized to securely receive the connector such that ridge 94 rests against an upper surface of PCB 150), and larger hole 162*a* can be configured to receive header pin 122 (e.g., to dictate a desired orientation of PCBs 150 relative to nozzle housing 66 during assembly, for example, to prevent user assembly error). In this embodiment, PCBs 150 can be inserted into nozzle housing 98 until depressible electrical connectors 74 securely lock into place (e.g., such that some spring or spring-like tension within the connector is released) into a hole (e.g., 162*b*) on the PCBs (e.g., thus securing PCBs 150 and depressible electrical connectors 74 relative both to each other and to the nozzle housing). Solder can be applied to the connection to strengthen the connection and/or enhance electrical communication between PCBs 150 and depressible electrical connectors 74. Header pins 122 may be inserted into holes on PCBs 150 (e.g., holes not occupied by electrical connectors 74, for example, in this embodiment, holes 162*a*) and optionally soldered into place (e.g., similar to as described above). In the embodiment shown, header pins 122 can additionally be secured to nozzle housing 98 through insertion of locating pins 170 into respective holes and/or slots in nozzle housing 98 (e.g., as shown in FIGS. 2A and 2B).

Figure 2D:
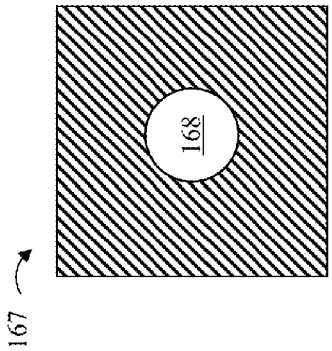
FIGS. 2D and 2E depict cross-sectional top views of additional electrodes that are suitable for use in at least the nozzle of FIG. 2C.
Figure 2E:
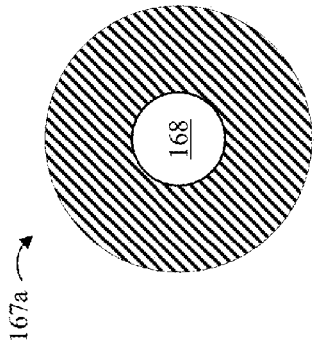
Figure 2C:
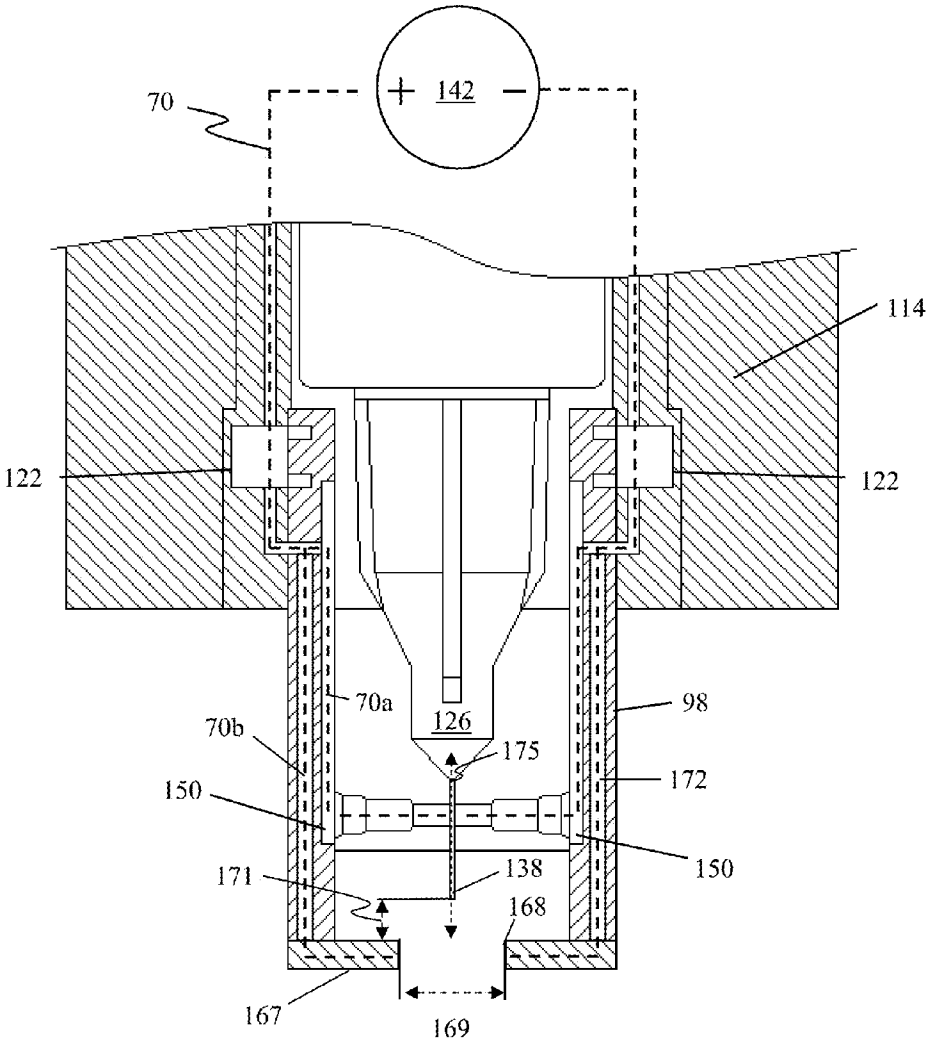
FIG. 2C depict a cutaway partially cross-sectional side view of the nozzle of FIG. 2A further comprising an additional electrode.

FIG. 2C depicts a side view of nozzle 66, further comprising an additional electrode 167 (e.g., disposed proximate second end 106 of housing 98). In the embodiment shown electrode 167 comprises a conductive material (e.g., stainless steel, silver, gold, copper, aluminum, graphite, conductive polymers, and/or the like). In the embodiment shown, a bias voltage can be applied to the electrode (e.g., via electrical communication, for example, through circuit 70, with power source 142, similar to as described above). For example, circuit 70 can comprise two parallel portions (both in electrical communication with power source 142) (e.g., portion 70*a* in electrical communication with conductive tip 138 and portion 70*b* in electrical communication with electrode 167). As shown, portion 70*b* can be disposed within channels 172 in housing 98 (e.g., extending from header pins 122 to electrode 167). However, in other embodiments, portion 70*b*, housing 98 and/or nozzle 66 can comprise any suitable structure that permits the functionality described in this disclosure, including, but not limited to, wires and/or traces disposed within and/or on housing 98, similar structure as described above (e.g., with PCBs, depressible electrical connectors, header pins, and/or the like, which may be the same and/or different than (e.g., additional to) those described with reference to FIGS. 2A and 2B), and/or the like. Some embodiments are configured such that a first bias voltage can be applied to conductive tip 138 and a second bias voltage, different than the first, can be applied to electrode 167 (e.g., via a dedicated circuit for the electrode and a dedicated (e.g., a second) circuit for the conductive tip, a voltage divider configured to split bias voltage between conductive tip 138 and electrode 167, which may be adjustable, and/or the like). Furthermore, in these embodiments, power source 142 can be configured to provide two distinct (e.g., different) voltages and/or two power sources can be provided (e.g., one power source in electrical communication with the conductive tip through a first circuit and a different power source connected to the electrode through a second circuit) which may be individually adjustable. Power sources may form part of the present printer heads and/or printers (described in more detail below), and/or may be provided separately. As shown, electrode 167 has an opening 168 (e.g., with a transverse dimension 169) that is substantially centered on a longitudinal axis 175 of the conductive tip (e.g., if opening 168 is circular, as shown, the opening and the conductive tip are substantially concentric). In the embodiment shown, opening 168 is larger than the inner diameter of the conductive tip 138. In the embodiment shown, electrode 167 is placed in proximity to conductive tip 138 (e.g., electrode 167 is placed within a distance 171 to conductive tip 138 such that an electrostatic field generated by the electrode under an applied bias voltage can affect an EHD printing jet during printing operation). In the embodiment shown, distance 171 is substantially fixed (e.g., and substantially defined by the configuration of nozzle housing 98), however, in other embodiments, the distance between the electrode and the conductive tip may be adjustable (e.g., through a slidable coupling, threaded connection, and/or the like between housing 98 and electrode 167). Additionally, in some embodiments, housing 98 may be slidably and/or rotatably (e.g., threadably) coupled to printer head 114 independently of dispensing device 126 and/or conductive tip 138 (e.g., to allow for an adjustable distance 171, alone or in addition to the above). FIGS. 2D and 2E depict cross-sectional views of electrodes suitable for use in the present nozzles. For example, such electrodes can comprise any cross-sectional shape which permits the functionality described in this disclosure, including, but not limited to, square (e.g., FIG. 2D, or a "plate"), polygonal, and/or the like (e.g., and may have rounded corners), circular (e.g., electrode 167*a* of FIG. 2E, or a "ring"), elliptical, and/or otherwise rounded, and/or the like. Electrode 167 can be configured to provide desirable EHD printing properties. For example, transverse dimension 169, distance 171, an applied bias voltage to electrode 167 and/or the conductive tip 138, and/or the like can be adjusted to control EHD printing properties (e.g., to focus the EHD printing jet during printing operation). The addition of electrode 167 can also enhance electrostatic force generation (e.g., to facilitate and/or enhance printing on a substrate with a low conductivity).

The assembled nozzle 66 can then be coupled to (e.g., inserted into) printer head 114 (e.g., and secured as described above). In the embodiment shown, reservoir 134 can be coupled to (e.g., inserted into) printer head 114 and turned to engage threaded portion 130 of dispensing device 126 in order to securely fasten and/or seal dispensing device 126 to reservoir 134 and/or printer head 114 (e.g., for printing operation). Through such features, the present dispensing devices (e.g., 126) can be quickly and easily replaced within the nozzle (e.g., in the event of damage due to arcing, for example, to conductive tip 138). For example, nozzle housing 98 can be removed from printer head 114 and depressible electrical connectors can allow dispensing device 126 to be removed from nozzle housing 98 with minimal effort. Additionally, in the event of more extensive damage, the entire nozzle assembly can be easily be replaced, if needed.

Figure 5:
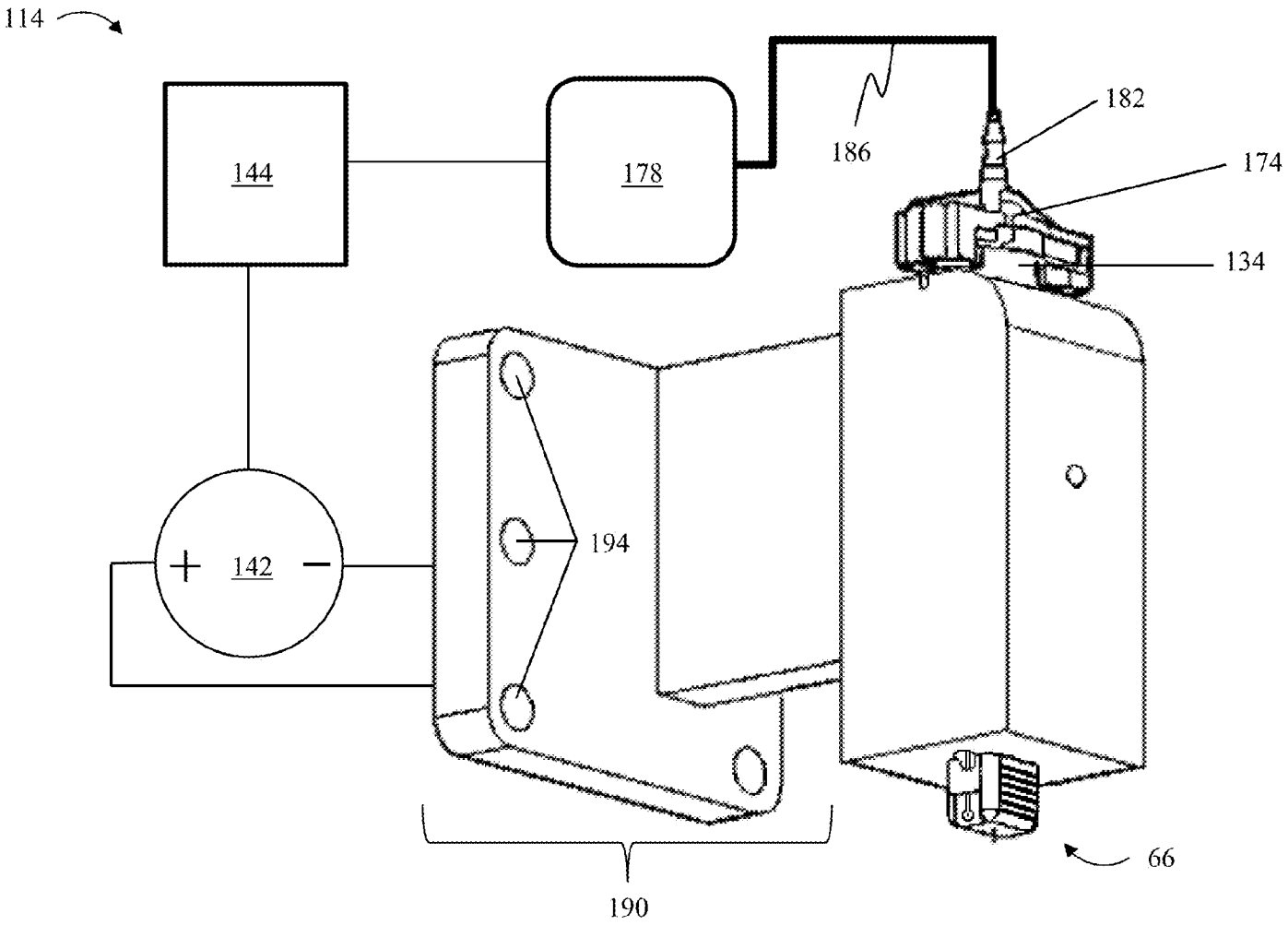
FIG. 5 depicts a perspective view of a first embodiment of the present printer heads.

FIG. 5 depicts a perspective view of a first embodiment 114 of the present printer heads. In the embodiment shown, printer head 114 housing may be fabricated using a SLA printer. In the present embodiments, printer head 114 can comprise any of the present printer nozzles (e.g., nozzle 66, as described above). In the embodiment shown, printer head 114 comprises a reservoir 134 in fluid communication with nozzle 66, and reservoir 134 is configured to contain printing media (e.g., reservoir 134 is substantially hollow and sealable, for example, comprising a syringe). In this embodiment, reservoir 134 has an internal volume of about 3 milliliters (mL) and a cap 174 (e.g., an engineered fluid dispensing (EFD) cap) that can be removed to permit filling reservoir 134 with printing media (e.g., cap 174 is connected and/or sealed to reservoir 134 via a screw, compression and/or the like connection). In the embodiment shown, reservoir 134 is configured to be coupled to a fluid source 178 (e.g., a precision pressure regulator) such that fluid source 178 can deliver fluid (e.g., air) to or remove fluid from reservoir 134 to adjust an internal pressure (e.g., back pressure) of the reservoir (e.g., to vary and/or control the hydrostatic pressure at the exit of conductive tip 138 of nozzle 66 during printing operation).

Unless otherwise indicated by the context of its use, the term "pressure" includes, but is not limited to, positive pressures, negative (vacuum) pressures, and zero (ambient) pressures, all relative to an ambient (e.g., atmospheric) pressure. For example, in the embodiment shown, cap 174 comprises a nipple 182 configured to accept a fluid line 186 from fluid source 178. Nipple 182 can be and/or can be configured to be connected to fluid line 186 through any structure that permits the functionality of this disclosure, including, but not limited to, barbed, compression, push lock, and/or like fittings and/or the like. Some embodiments of the present printer heads comprise a fluid source (e.g., fluid source 178 coupled to printer head 114 and forming part of printer head 114). In the embodiment shown, printer head 114 further comprises a power source 142 (e.g., a Trek 615-10 high voltage generator, available from TREK, Inc.) configured to electrically communicate with nozzle 66 (e.g., through circuit 70 and to apply a bias voltage and/or ejection voltage across conductive tip 138), such as, for example, through wired connections within printer head 114 comprising conductive receptacles and/or sockets connected to header pins 122 of circuit 70. Generally, in a voltage pulse train (e.g., which can be supplied by the power source(s) of the present disclosure), a bias voltage can correspond to a base voltage of the pulse train, and an ejection voltage can correspond to a peak voltage of the pulse train).

In the embodiment shown, printer head 114 further comprises a processor 144 (e.g., a microprocessor). Unless otherwise indicated by the context of its use, the terms "a processor" or "the processor" mean one or more processors and may include multiple processors configured to work together to perform a function. Processor 144 can be configured to control any fluid source (e.g., 178) and/or power supply (e.g., 142) of the present printer heads and/or printers (e.g., based on data captured by sensors, described in more detail below). In those of the present embodiments that include a processor, the present printer heads and/or printers can also comprise at least one sensor (e.g., a pressure sensor) configured to capture data indicative of the internal pressure (e.g., back pressure) within reservoir 134 (e.g., a sensor disposed within reservoir 134). Processor 144 can, for example, receive data from the sensor and control fluid source 178 based on the data (e.g., to correspond the internal pressure of reservoir 134 to a desired pressure value). In some embodiments of the present printer heads, fluid source 178, power source 142, and/or processor 144 may form part of the present printers, and in such embodiments, may not form part of the present printer heads. In the embodiment shown, printer head 114 comprises a mount 190 configured to securely locate printer head 114 (e.g., relative to a printer and/or a working surface). In the embodiment shown, mount 190 comprises mounting holes 194 configured to accept fasteners (e.g., screws, pins, and/or the like) to secure printer head 114 to a printer; however, in other embodiments, printer head 114 can be mounted with any structure which permits the functionality described in this disclosure. Components of the present nozzles and/or printers (e.g., printer head 114 housing and nozzle housing 98, reservoir 134, cap 174, PCBs 150, dispensing device 126, depressible electrical connectors 74, header pins 122, wiring, and/or the like) can be commercially available, and may comprise a combined cost of about $50 United States dollars.

Figure 6:
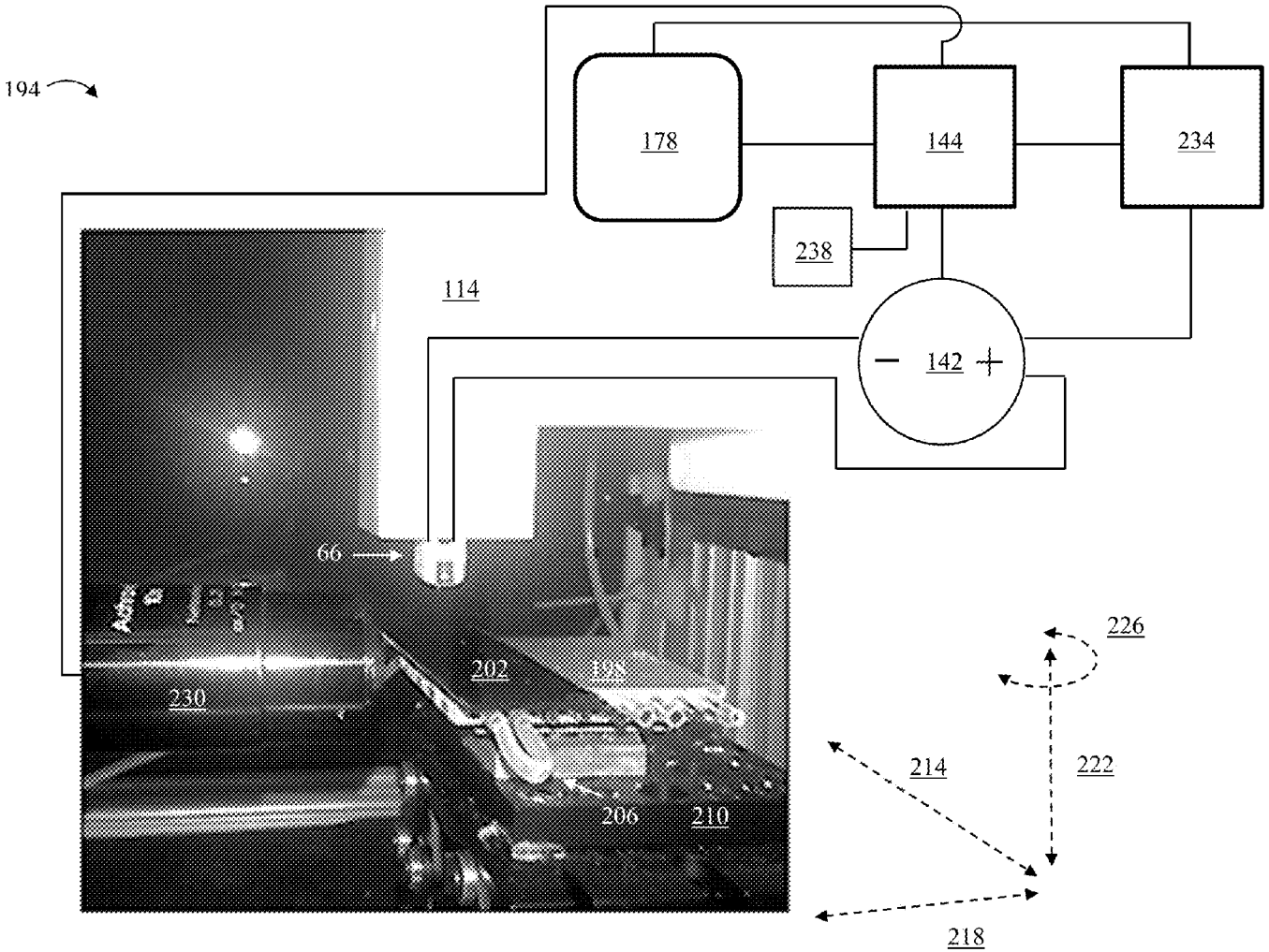
FIG. 6 depicts a perspective view of a first embodiment of the present printers.

FIG. 6 depicts an embodiment 194 of the present printers. In the present embodiments, printer 194 can comprise any of the present printer heads (e.g., printer head 114). In the embodiment shown, printer 194 comprises printer head 114 and a working surface 198 (e.g., a 300 by 300 mm working surface). Working surface 198 can be configured to secure a substrate 202 for printing operation. For example, the working surface can comprise a vacuum surface such that substrate 202 is securely held in place by vacuum (e.g., negative pressure, supplied through vacuum lines 206 by a pump or fluid source (not expressly shown)). In other embodiments, working surface 198 can secure substrate 202 through any alternative and/or additional structure(s) that permits the functionality described in this disclosure, including, but not limited to, clamps, fasteners, interlocking features, latches, adhesive, and/or the like.

In the embodiment shown, printer 194 comprises at least one orientation actuator 210 (e.g., stage(s)) configured to adjust an orientation of working surface 198 relative to printer head 114. In the embodiment shown, orientation actuator 210 comprises three stages (e.g., an x-stage, a y-stage, and a z-stage) configured to move working surface 198 relative to printer head 114 (e.g., in directions along transverse axes 214, 218, and 222, respectively). In other embodiments, orientation actuator 210 can comprise (e.g., additionally) a theta stage configured to move working surface 198 relative to printer head 114 in a rotational direction, as indicated by arrow 226.

In the embodiment shown, printer 194 comprises a processor 144 configured to adjust the orientation of working surface 198 relative to printer head 114 (e.g., through control of orientation actuator 210). However, in other embodiments, orientation actuator(s) (e.g., 210) may be coupled to the printer head (e.g., as opposed to or in addition to, the working surface, and be configured to move the printer head (e.g., 114) relative to the working surface. In the embodiment shown, printer 194 comprises at least one sensor 230 configured to capture data indicative of the orientation of working surface 198 relative to printer head 114 (e.g., a high-speed camera, such as a Phantom V-130, available from Vision Research, Inc., configured to capture image data). In the embodiment shown, processor 144 can be further configured to adjust the orientation of the working surface relative to the printer head based on the data captured by the at least one sensor (e.g., by receiving data from sensor 230 and calculating the location of the printer head and/or nozzle relative to the working surface and/or substrate 202). For example, working surface 198 and/or substrate 202 may comprise fiducials which can be recognized by processor 144 in data captured by sensor 230 (e.g., by analyzing the pixels in images captured by sensor 230 to determine fiducial locations). The location of printer head 114 and/or nozzle 66 can be determined (e.g., through calibration and/or information provided by orientation actuator 210) and/or acquired through locating fiducials disposed on printer head 114 and/or nozzle 66. By comparing the relative locations of substrate 202 and/or working surface 198 with printer head 114 and/or nozzle 66, processor 144 can precisely actuate any required adjustments (e.g., by communicating with orientation actuator 210) (e.g., a machine vision system).

In the embodiment shown, printer 194 comprises a fluid source 178 and a power source 142, the operation of each substantially similar to as described above with reference to FIG. 5. In this embodiment, printer 194 comprises a user interface 234 configured to allow user monitoring and/or control of printer 194 (e.g., starting and stopping of printing operations, manual printing operations, and/or the like) as well as to display information to a user (e.g., information regarding printing operations, such as, for example, data from sensor 230, orientation actuator 210, and/or the like, as well as regarding printer operation, such as, for example, hardware failures, software failures, and/or the like). Such configuration of user interface 234 may be accomplished through a graphical user interface (GUI) (e.g., provided by software) on a computer which may be connected to and/or in control of printer 194, sensor 230, orientation actuator 210, power source 142, fluid source 178 and/or the like. In some embodiments, processor 144 can perform many or all of the monitoring and/or control functions and be configured to relay information to and/or from user interface 234 (e.g., as opposed to the user interface being provided by a separate computer and/or processor). In the embodiment shown, printer 194 further comprises a memory 238 configured to store information regarding printing operations, for example, desired printing patterns. For example, processor 144 can read information from memory 238 and communicate with power source 142, fluid source 178, user interface 234, orientation actuator 210, and/or sensor 230 to effectuate the desired patterns (e.g., to print the desired patterns onto substrate 202).

Figure 7:
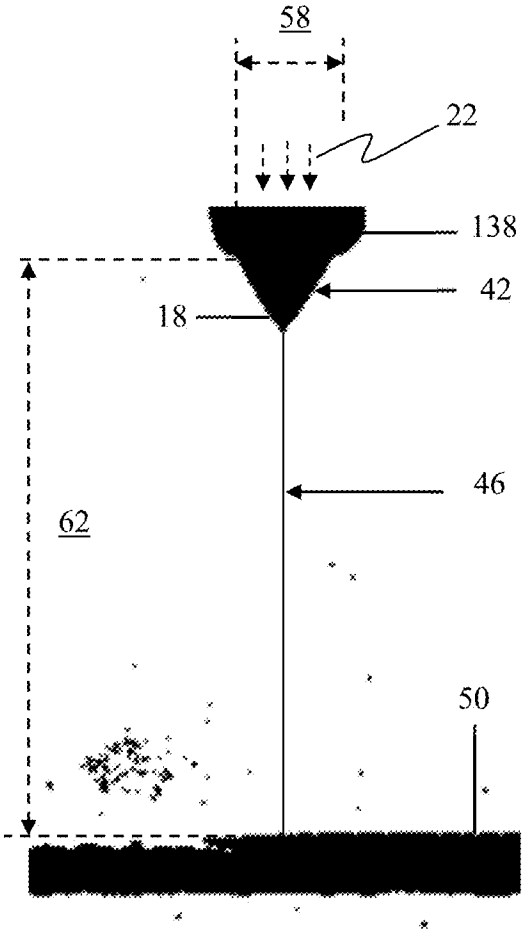
FIG. 7 depicts an enlarged side view of certain components of a nozzle of the first embodiment of the present printers during a printing operation mode.

FIG. 7 depicts an enlarged side view of the nozzle exit (e.g., end of conductive tip 138) of an EHD printer (e.g., 194) of the present disclosure during printing operation. As shown, printing media 18 (e.g., in this example, ethylene glycol) at the nozzle forms a cone 42 (e.g., due to repulsive Coulombic and electrostatic forces, as described above with reference to FIGS. 1A and 1B) and a stable jet 46 of printing media is ejected towards substrate 50 (e.g., a gold coated glass slide). In this example, the internal pressure (e.g., back pressure, indicated by arrows 22) of the printing media reservoir is 0.5 kilopascals (kPa), the bias voltage applied to the conductive tip is 2 kilovolts (kV), the stand-off distance 62 is within the range of about 0.8 to about 1.0 mm, and the conductive tip has an outer diameter of 0.24 mm and an inner diameter 58 of 0.1 mm.

Some of the present methods include inserting a dispensing device (e.g., 126) with a conductive tip (e.g., 138) into an EHD nozzle (e.g., into nozzle housing 98), where the nozzle has at least one depressible electrical connector (e.g., 74) and the inserting is such that the depressible electrical connector contacts the conductive tip (e.g., as shown in FIG. 2A), and applying a bias voltage across the conductive tip by enabling electrical communication between the depressible electrical connector and a power source (e.g., 142) (e.g., through circuit 70). In others of the present methods, the nozzles can include an electrode (e.g., 167) and the methods can further comprise applying a voltage (e.g., by enabling electrical communication between the power source, for example, power source 142 and/or a second power source).

Figure 8:
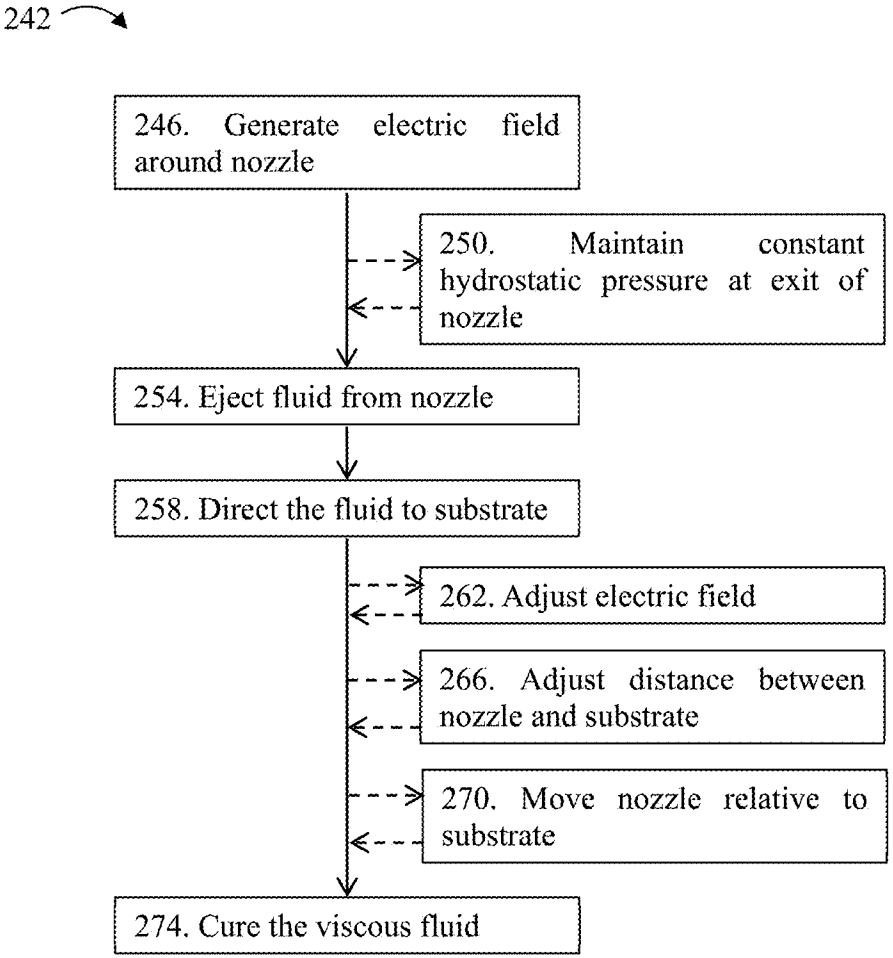
FIG. 8 depicts a flow chart of some of the present methods for performing maskless lithography.

Referring to FIG. 8, others of the present methods comprise performing (242) maskless lithography by generating an electric field around an EHD printer nozzle (e.g., 66) (246), the nozzle having a housing (e.g., 98) with at least one depressible electrical connector (e.g., 74) and a dispensing device (e.g., 126) with a conductive tip (e.g., 138) disposed in the housing such that electrical communication is permitted between the conductive tip and the depressible electrical connector, where the electric field is generated by enabling electrical communication between the depressible electrical connector and a power source (e.g., 142) to apply a bias voltage across the conductive tip. Though not required in all embodiments, a constant hydrostatic pressure (e.g., 22) can be maintained 250 at the exit of the nozzle (e.g., at the end of conductive tip 138), for example, by processor (e.g., 144) control of a fluid source (e.g., 178) coupled to the reservoir (e.g., 134) in fluid communication (and thus pressure communication) with the dispensing device (e.g., 126) and therefore the conductive tip (e.g., 138). In others of the present methods, the nozzles can include an electrode (e.g., 167) and the methods can further comprise adjusting a distance (e.g., 171) between the electrode and the conductive tip (e.g., 138).

Embodiments of the present methods can further comprise ejecting 254 viscous fluid (e.g., printing media 18) from the nozzle (e.g., through application of pressure 22 and bias voltage from power source 142). Viscous fluid (e.g., printing media 18) can comprise a variety of materials, as described above. In some embodiments, the viscous fluid comprises a negative epoxy resist (e.g., KMPR photoresists and/or SU-8 photoresists, available from MicroChem Corp.) modified with at least one of a surfactant and/or a solvent such that the viscous fluid has a viscosity and a surface tension suitable for maskless lithography (e.g., a high viscosity, for example, from about 300 cP to about 1000 cP to print relatively thick microstructures, for example features having a width on the order of a few hundreds of micrometers and a height on the order of tens of micrometers). In some embodiments, the viscous fluid comprises an ionic metal salt (e.g., zinc nitrate, zinc acetate, tin nitrate, and/or the like). In some embodiments, the viscous fluid comprises a matrix material (e.g., polyethylene glycol, polyvinylpyrrolidone, and/or the like). Additionally, a solvent (e.g., ethylene glycol, N-Methyl-2-pyrrolidone (NMP), methanol, and/or the like) or surfactant (e.g., a material which can reduce the surface tension of the viscous fluid) can be included within any of the viscous fluids used in the methods explicitly described above.

In some embodiments, the viscous fluid comprises poly(2,3-dihydrothieno-1,4-dioxin)-poly(styrenesulfonate) ("PEDOT:PSS"). PEDOT:PSS is a generally transparent and conducting polymer that is ductile, elastic, and stable, having a gauge factor of 5-20 (as compared to a conventional metal film having a gauge factor of 2). Thus, PEDOT:PSS may be particularly suited for strain-based sensor applications, such as, for example, pressure, strain, and touch sensors (e.g., for use in touch screen technologies). Such viscous fluids comprising PEDOT:PSS (e.g., comprising from 1-10% by weight PEDOT:PSS) may comprise a matrix material (e.g., comprising from 1-20% by weight of the matrix material) (e.g., a dissolvable polymeric material such as polyvinylpyrrolidone, polyvinyl-alcohol, mixtures thereof, and/or the like), a solvent (e.g., from 10-90% by weight of the solvent) (e.g., N-methylpyrrolidone, dimethyl sulfoxide, methanol, ethanol, mixtures thereof, and/or the like), and/or the like.

Figure 9B:
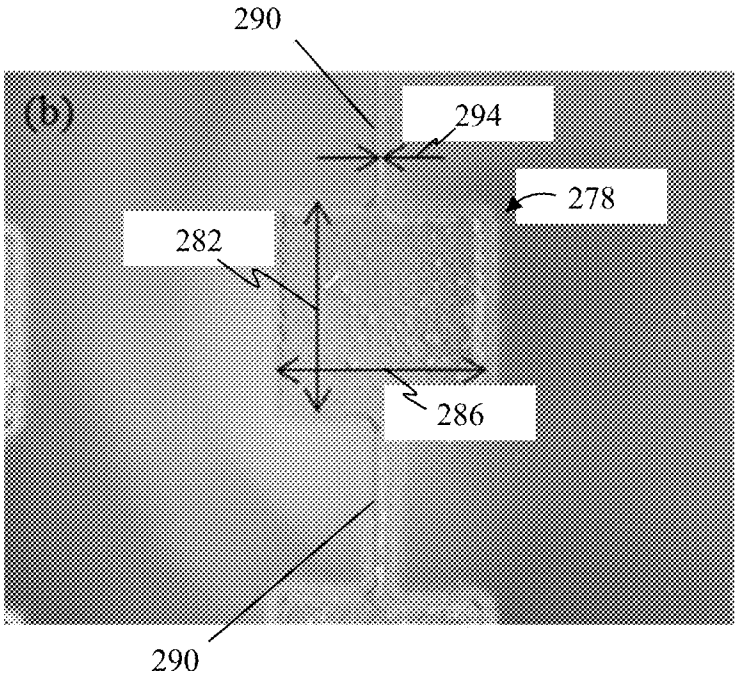
FIGS. 9A and 9B depict features printed using some embodiments of the present viscous fluids.
Figure 9A:
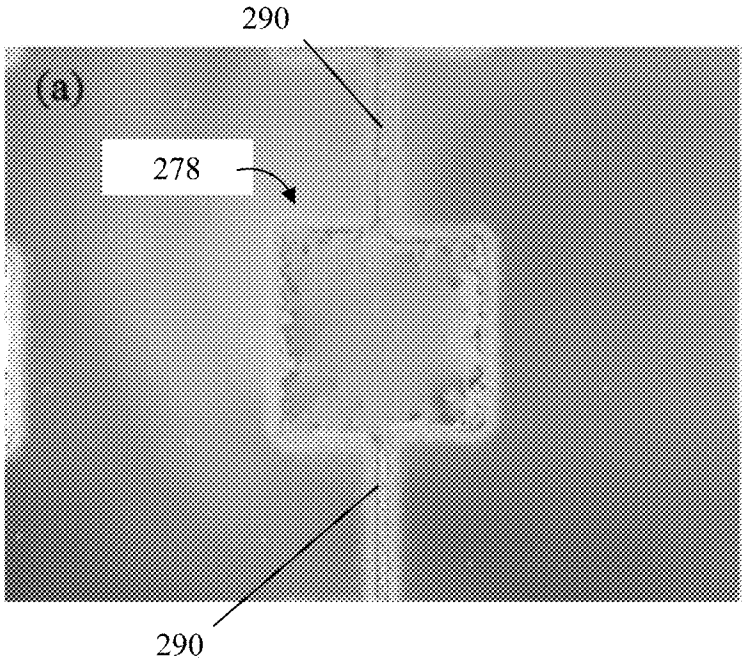

FIGS. 9A and 9B depict interconnected pads 278 printed on a gold-coated glass substrate as printed (FIG. 9A) and after drying (e.g., at room temperature for approximately 3 hours) (FIG. 9B). As shown, after drying, pads 278 have a length 282 of approximately 2220 μm, a width 286 of approximately 2160 μm, with interconnecting features 290 between pads having a transverse dimension 294 of approximately 150 μm.

Some embodiments of the present methods include directing 258 the fluid to a substrate (e.g., 202). Substrates of the present methods can comprise a variety of materials; however, it can be desirable that substrates be electrically conductive and/or coated with a thin electrically conductive material to facilitate generation of electrostatic forces between conductive tip (e.g., 138) and the substrate. For example, the substrate (e.g., 202) can comprise, but is not limited to comprising, silicon (e.g., a wafer), glass, polymer, ceramic, and/or the like. While not required in all embodiments, the electric field between the conductive tip (e.g., 138) and the substrate (e.g., 202) can be adjusted 266 (e.g., by processor 144 control of power source 142). Also, while not required in all embodiments, the distance between the nozzle (e.g., end of conductive tip 138) and the substrate (e.g., 202) can be adjusted 270 and/or the nozzle can be moved relative to the substrate (e.g., by processor 144 monitoring of sensor 230 and/or control of orientation actuator 210). Fluid (e.g., printing media 18) selection, bias voltage applied to the nozzle (e.g., conductive tip 138), printing speed (e.g., speed at which printer head 114 moves relative to substrate 202, for example, during actuation of orientation actuator 210), and stand-off distance (e.g., 62) can have an effect on the characteristics of printed features.

While studies have been conducted that can predict jet characteristics, printed feature characteristics (e.g., shape, line width, thickness, and/or the like) can sometimes be difficult to predict. Line width and thickness can be described in terms of flow rate and jetting diameter in conjunction with post deposition spreading. Flow rate can be approximated as:

$$Q \approx \frac{\pi d_N^4}{128\,\mu L}\left(\Delta P + \frac{1}{2}\varepsilon_0 E^2 - \frac{4\gamma}{d_N}\right) \tag{1}$$

where Q represents flow rate, $d_N$ and L represent the diameter and length of the nozzle, respectively, ΔP represents the hydrostatic pressure with respect to the nozzle exit, $\Sigma_0$ represents the permittivity of free space, γ represents the surface tension of the air-fluid interface, and E represents the magnitude of the electric field [1, 3]. Jetting diameter can be approximated as:

$$d \propto \sqrt{\frac{\gamma}{\varepsilon_0}}\,\frac{\sqrt{d_N}}{E} \tag{2}$$

[1, 3]. While EQS. (1) and (2) can predict flow rate and jetting diameter with relative accuracy, predicting the geometry of a printed feature (e.g., shape, line width, thickness, and/or the like) can be difficult to the complex nature of the factors involved. For example, flow rate is directly proportional to applied bias voltage (e.g., as applied bias voltage is directly proportional to the magnitude of the electric field); however, jetting diameter is inversely proportional to applied bias voltage [3]. Therefore, for a given fluid (e.g., with given characteristics), an increase of applied bias voltage can increase flow rate while decreasing jetting diameter (which constitute counteracting values with respect to printed feature geometry). To illustrate, smaller jetting diameters could be expected to create printed features with smaller line widths, however, more fluid is typically ejected with increased flow rate, which can result in more post deposition spreading (and potentially features with larger line widths). Additionally, post deposition spreading and/or printed feature characteristics can be a function of volume of fluid deposited per unit area, solvent evaporation rate, fluid viscosity, fluid surface tension, substrate properties, and/or the like. For example, fluids with a high surface tension may hold together after printing, resulting in minimal post deposition spreading, and fluids with a low surface tension may spread out after printing, resulting in a larger post deposition spreading (e.g., and thus an increase in line width). Table 1 provides an example of such effects.

TABLE 1

Fluid Viscosity and Applied Bias Voltage versus Printed Line Width and Thickness for a Printing Speed of 1000 mm/minute

| Ink | Applied Bias Voltage (V) | Line width (μm) | Thickness (nm) |
|---|---|---|---|
| I-455 | 850 | 43 (42*) | 607 (48*) |
| I-455 | 750 | 39 (38*) | 416 (33*) |
| I-312 | 850 | 47 (46*) | 476 (38*) |
| I-312 | 750 | 37 (36*) | |

Values marked with an asterisk (*) indicate measured values after sintering (described in more detail below). Measurements were performed using a scanning electron microscope (SEM) and surface profile meter. I-312 and I-455 represent Zinc-containing fluids with viscosities of 312 and 455 cP, respectively, which can otherwise be similar to the viscous fluids described above. Both fluids contain the same Zinc concentration, solid loading, solvent percentage, surface tension, and conductivity values. As shown, for a given applied bias voltage, in general, more viscous fluids produce printed structures with smaller widths, but larger thicknesses, at least in part due to viscous effects on post deposition spreading (e.g., more viscous inks may more resistant to post deposition spreading than less viscous inks). For example, at a bias voltage of 850 volts (V), features printed with I-455 fluid have a line width of 43 μm, and features printed with I-312 fluid have a line width of 47 μm (e.g., more viscous fluid I-455 generally prints features with smaller line widths than less viscous fluid I-312). Also at 850 V, I-455 fluid prints features with a thickness of 607 nanometers (nm), and I-312 fluid prints features with a thickness of 476 nm (e.g., more viscous fluid I-455 generally prints features with larger thicknesses than less viscous fluid I-312). Using I-455 and/or I-312 fluid in the apparatuses of the present disclosure, ZnO macrostructures with line widths ranging from about 18 to about 65 μm and thicknesses ranging from about 33 to 62 nm can be printed. As shown in Table 1, the present fluids are suitable for maskless lithography applications (e.g., for fabricating TFT and/or gas sensors, and/or the like).

Figure 10A:
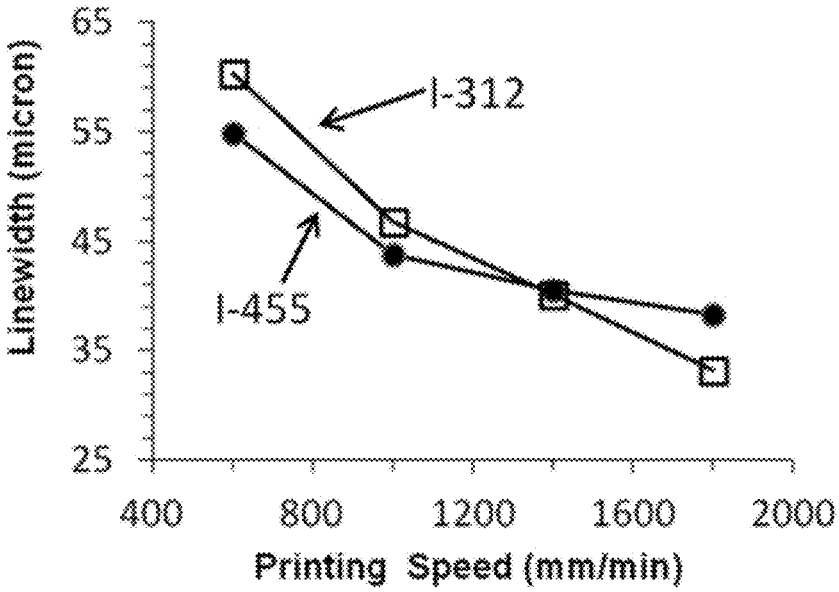
FIGS. 10A and 10B are graphs representing some aspects of the relationship between printed feature line width, printing speed, printing media viscosity, and applied bias voltage.
Figure 10B:
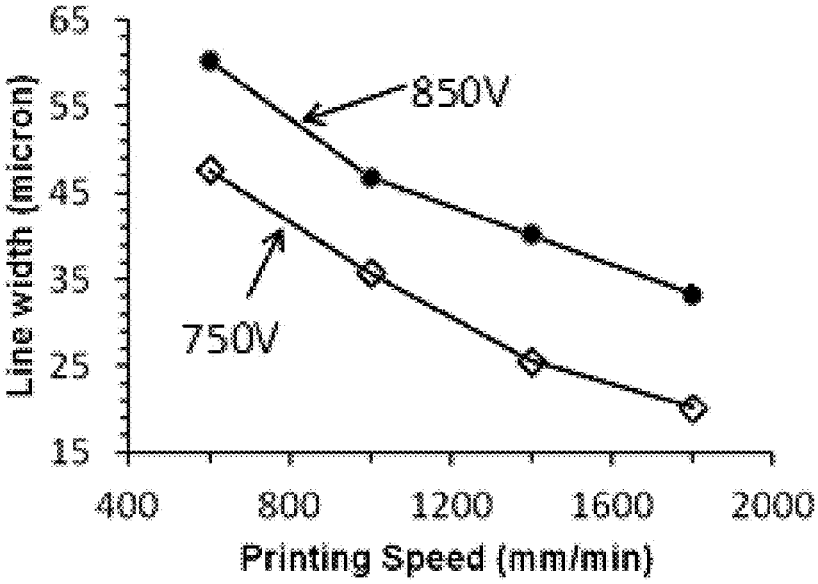

Some aspects of the relationship between printed feature line width, fluid viscosity, applied bias voltage, and printing speed are shown in FIGS. 10A and 10B. FIG. 10A graphs data for both fluids (I-312 and I-455) at an applied bias voltage of 850 V. As shown, for both fluids, line width decreases with printing speed, and such decreases are more pronounced for the lower viscosity fluid I-312. This may be explained, in part, due to post deposition spreading. Dispensed fluid volume per unit area decreases with increases in printing speed. At low volumes per unit area, solvent may evaporate before the printed features can undergo substantial post deposition spreading. Referring now to FIG. 10B, graphed is data for I-312 fluid printed feature line width at applied bias voltages of 750 V and 850 V at various printing speeds. As shown, the effect of bias voltage on printed feature characteristics (e.g., line width) dominates over effects due to viscosity (e.g., compare FIG. 10A with FIG. 10B). Therefore, flow rate, as opposed to jetting diameter, may be a dominant factor in determining printed feature characteristics.

Figure 11:
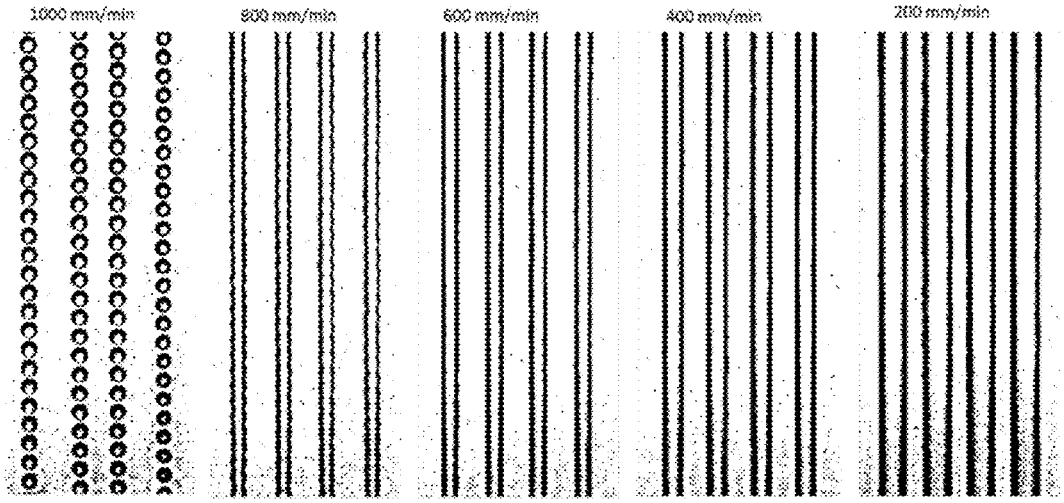
FIG. 11 depicts printed features at various printing speeds.

FIG. 11 shows some aspects of the relationship between printing speed and printed feature characteristics. The depicted features were printed at an applied bias voltage of 450 V (e.g., an ejection voltage of 650 V), an ejection frequency of 600 kilohertz (kHz), and a back pressure of 10 kilopascals (kPa). As shown, generally, at low printing speeds, printed features resemble lines (e.g., from about 200 mm/min to about 600 mm/min, for this particular bias voltage, back pressure, and fluid). Also, as printing speeds increase, line width tends to decrease. At sufficiently high printing speeds (e.g., above about 800 mm/min) printed features resemble dots. Therefore, by controlling printing speed, printed feature characteristics can be controlled. For example, for drop on demand dot printing (e.g., where dot features are desirable), higher printing speeds may be advantageous.

Figure 12:
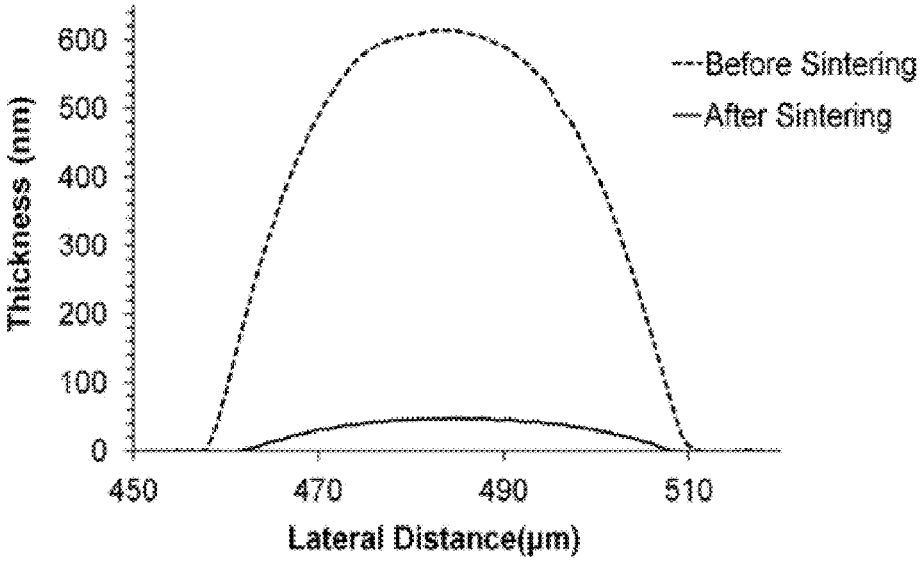
FIG. 12 is a graphical representation of printed feature characteristics before and after sintering.

Referring back to FIG. 8, in the embodiment shown, the present methods for performing maskless lithography can comprise curing 274 the viscous fluid. Curing can comprise heating the printed features after printing by baking (e.g., at a temperature within the range of approximately 100 degrees Celsius (° C.) to approximately 110° C., for a time of approximately one minute), sintering (e.g., at a temperature greater than or equal to approximately 400° C. for a time of approximately 45 minutes), and/or the like, as well as by exposure to light (e.g., by ultraviolet (UV) curing, for example, under approximately 500 watts (W) of power, for a time of about one minute). Specific curing parameters (e.g., power, temperature, time, and/or the like) can vary based on the materials in the printing media and/or the substrate. In some embodiments curing can comprise etching. FIG. 12 is a graphical representation of printed feature characteristics before and after sintering [4]. In the example depicted, features printed in I-455 fluid at a printing speed of 1000 mm/min and an applied bias voltage of 850 V were sintered (e.g., heated above approximately 400° C. for approximately 45 minutes). At these temperatures, similar to other fluids with metallic elements or metal oxide nanoparticles, I-455 fluid produces polycrystalline ZnO (e.g., a metal oxide printed microstructure). No detectable cracks or pinholes were observed, and as shown, sintering resulted in a lateral shrinkage (e.g., a line width decrease) of approximately 3% and a thickness shrinkage (e.g., a thickness decrease) of approximately 92%. The relatively large thickness shrinkage may be attributed, in part, to the removal of matrix materials that may occur during sintering, and the relatively small lateral shrinkage may be attributed, in part, to a strong adhesion of the fluid to the substrate.

The present masked based lithography methods (e.g., 242) can offer lower manufacturing costs, less use of chemicals (and thus a lower environmental impact), and faster production cycles, as well as flexibility in substrate size and shape, and fluid selection.

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

REFERENCES

These references, to the extent that they provide exemplary procedural or other details supplementary to those set forth herein, are specifically incorporated herein by reference.

1. U. Chen. et al., "A new method for significantly reducing drop radius without reducing nozzle radius in drop-on-demand drop production," *Phy. Fluids.,* 2002; 14: L1-L4.
2. J.-U Park et al., "High-resolution electrohydrodynamic jet printing," *Nat. Matter.,* 2007; 6: 782-789.
3. K. Choi et al., "Scaling laws for jet pulsations associated with high-resolution electrohydrodynamic printing," *Appl. Phy. Lett.,* 2008; 92: 123109 (1-3).

4. B. S. Barros et al., "Synthesis and X-ray Diffraction Characterization of Nanocrystalline ZnO Obtained by Pechini Method," *Inorganic Matter.,* 2006, 42(12):1348-1351.

The invention claimed is:

1. An electrohydrodynamic (EHD) printer nozzle comprising:

a circuit having at least one depressible electrical connector; and a housing having a first end, a second end, and a channel extending from the first end to the second end, the housing configured to be releasably coupled to a printer head, and the channel configured to removably receive a dispensing device with a conductive tip such that electrical communication is permitted between the conductive tip and the at least one depressible electrical connector;

where the circuit is configured to apply a voltage across the conductive tip; and where the EHD printer nozzle is configured to be removably coupled to an EHD printer head.

2. The nozzle of claim 1, where the circuit comprises at least one header pin configured to be in electrical communication with the printer head when the first end is coupled to the printer head.

3. The nozzle of claim 1, where the circuit comprises two depressible electrical connectors, the depressible electrical connectors configured to contact substantially opposite sides of the conductive tip.

4. The nozzle of claim 3, where at least one depressible electrical connector comprises a spring-loaded electrical connector.

5. The nozzle of claim 1, where the nozzle comprises an electrode disposed proximate the second end of the housing.

6. The nozzle of claim 5, comprising a second circuit configured to apply a voltage across the electrode, where the circuit is configured to apply a first voltage across the conductive tip, and the second circuit is configured to apply a second voltage across the electrode, where the second voltage is different than the first voltage.

7. An EHD printer head comprising:

the nozzle claim 1; and a reservoir in fluid communication with the nozzle, the reservoir configured to contain printing media;

where the reservoir is configured to be coupled to a fluid source such that the fluid source can deliver fluid to or remove fluid from the reservoir to adjust an internal pressure of the reservoir.

8. An EHD printer comprising:

the printer head of claim 7; and a power source configured to supply a voltage to the conductive tip.

9. The EHD printer of claim 8, comprising a fluid source configured to deliver fluid to or remove fluid from the reservoir.

10. The EHD printer of claim 8, comprising at least one orientation actuator configured to adjust an orientation of a working surface of the EHD printer relative to the printer head.

11. The EHD printer of claim 10, comprising at least one sensor configured to capture data indicative of the orientation of the working surface relative to the printer head.

12. The EHD printer of claim 11, comprising a processor configured to adjust the orientation of the working surface relative to the printer head based on the data captured by the at least one sensor.

13. A direct printing method comprising:

generating an electric field around an electrohydrodynamic (EHD) printer nozzle, the nozzle having a housing with at least one depressible electrical connector and a dispensing device with a conductive tip, where the dispensing device is removably disposed in the housing such that electrical communication is permitted between the conductive tip and the depressible electrical connector, and where the electric field is generated by enabling electrical communication between the depressible electrical connector and a power source to apply a voltage across the conductive tip; and ejecting viscous fluid from the nozzle onto a substrate.

14. The method of claim 13, where the viscous fluid comprises a negative epoxy resist modified with at least one of a surfactant and solvent such that the viscous fluid has a viscosity and a surface tension suitable for maskless lithography.

15. The method of claim 13, where the viscous fluid comprises poly(2,3-dihydrothieno-1,4-dioxin)-poly(styrenesulfonate), a surfactant, and a solvent.

16. The method of claim 15, where the viscous fluid comprises from 1-10% poly(2,3-dihydrothieno-1,4-dioxin)-poly (styrenesulfonate).

17. The method of claim 15, where the surfactant comprises anionic fluorinated polyether di(ammonium sulfate) salt.

18. The method of claim 13, where the viscous fluid comprises an ionic metal salt, a polymer matrix material, a surfactant, and a solvent.

19. The method of claim 18, where the ionic metal salt comprises at least one of zinc nitrate, zinc acetate, and tin nitrate.

20. The method of claim 18, where the viscous fluid comprises from 1-20% of the polymer matrix material.

21. The method of claim 18, where the polymer matrix material comprises at least one of polyethylene glycol, polyvinylpyrrolidone, and polyvinyl alcohol.

22. The method of claim 18, where the solvent comprises at least one of ethylene glycol, N-Methyl-2-pyrrolidone (NMP), N-methylpyrrolidone, dimethyl sulfoxide, ethanol, and methanol.

23. The method of claim 18, where the surfactant comprises anionic fluorinated polyether di(ammonium sulfate) salt.

* * * * *